United States Patent [19]

Murphy et al.

[11] Patent Number: 4,804,179

[45] Date of Patent: Feb. 14, 1989

[54] MULTI FUNCTION FOLDABLE EXERCISE MACHINE

[76] Inventors: Robert J. Murphy, 18 Kidd Close, Bidwell, N.S.W. 2770, Australia;

[21] Appl. No.: 916,511

[22] PCT Filed: Nov. 8, 1985

[86] PCT No.: PCT/AU85/00273

§ 371 Date: Sep. 4, 1986

§ 102(e) Date: Sep. 4, 1986

[87] PCT Pub. No.: WO86/02848

PCT Pub. Date: May 22, 1986

[30] Foreign Application Priority Data

Nov. 9, 1984 [AU] Australia ..... PG8053

[51] Int. Cl.[4] ..... A63B 23/00

[52] U.S. Cl. ..... 272/117; 272/134; 272/144

[58] Field of Search ..... 272/134, 144, 117

[56] References Cited

U.S. PATENT DOCUMENTS 4,098,502 7/1978 Faust ..... 272/144

4,582,319 4/1986 Luna ..... 272/134 X

*Primary Examiner*—Carl D. Friedman

*Attorney, Agent, or Firm*—Hill, Van Santen, Steadman & Simpson

[57] ABSTRACT

Improved multifunction foldable and compact exercise machine which comprises an upright floor and supported mainframe having an overhead bar and also having a bench pivotally attached to it. The mainframe has attached to it at least one exercise station connected to the upper portion of the mainframe. The exercise station connected to the upper portion of the mainframe is interconnected with the exercise station connected to the lower portion of the mainframe. The latter exercise station provides a counterweight for the former exercise station thus providing proper variation of resistance to a muscle in all positions of movement during an exercise.

38 Claims, 6 Drawing Sheets

MULTI FUNCTION FOLDABLE EXERCISE MACHINE

The present invention relates to an improved exercise machine and more particularly to a machine for developing and conditioning various parts of the body which on one hand can be folded for transportation on wheels and/or storage yet, on the other hand, has a combination of exercise stations enabling a broad range of exercises to be performed on the one machine.

A multiplicity of combination exercise devices are presently known and used.

The simplest of of these combination devices are those which allow the performance of only a few exercises. They generally comprise a basic exercise bench which is usually adjustable with a leg exercise machine usually at the foot of the bench. Resistance weights can be attached to the leg machine depending upon the amount of resistance required by the user. Also a barbell support means is generally adapted to the machine. These devices limit the scope of the body exercises which can be performed.

The next class of combination multi-gym devices contain an additional attachment known as a dip bar attached to telescopic supports which can also be used as squat racks allowing for an increased number of exercises using a barbell supported by a saddle adjacent each of the dip bars. Although it is claimed by the manufacturers of these multi-gym devices that a persons whole body can be exercised with these machines they are not technologically advanced by comparison to the present invention as they do not provide the practical benefits of the free weight concept in body building. Modern day body building demands precision machines which can allow the resistance provided by the weights at each station to be correctly imposed commensurate with the abilities of a particular muscle when it is in a particular exercise mode. Improperly applied weight resistance can lead to a decrease in efficiency of muscle building from exercise.

The more advanced combination multi-gym devices also have attached to them a lat machine which in combination with dead weights at the end of a pulley allow exercise of muscles in the upper torso region of the body and in particular the arms.

The manufacturers and distributors of these lat machines boast simulated free weight motion of the resistance weights as the exercise is carried out, however, the desired concept in weight lifting and muscle building is actual rather than simulated free weight motion wherein drag from the dead weights which are usually pin weights is eliminated and conterweight resistance to the muscle is correctly applied.

The leg machines of the more simple combination multi-gym devices also rely on the dead weight principle to provide resistance for the leg muscles when performing the various leg exercises.

As with the lat machines of the prior art dead weight drag is also a problem with the leg machine as the resistance is not efficiently applied to the leg muscles throughout the range of motion.

In weightlifting exercises, the inertia or inertial resistance of the weight load must first be overcome before the exercise progresses.

Ideally, the resistance weight should be no heavier than the maximum force of the weakest muscle acting in the particular exercise movement to be accomplished.

During an exercise, the amount of force generated during contraction of the muscle varies throughout all the phases of the movement. Consequently, the maximum level of strength of the muscle occurs close to full contraction. In the prior art exercise machines it has been found that for certain exercises, the drag is at a maximum at the commencement of a muscle exercise, when the muscle is usually extended and thus at its weakest. This phenomenon is undesirable and its existance prevents physiologically efficient muscle building.

The presently known multi-gym devices do not allow application of the true free weight concept due to the geometry of the various machines incorporated in the overall device and due to the resistance weight functionality.

Among the more versatile combination multi-gym devices available there are those which incorporate facilities in most of the known stations for weight lifting exercises such as shoulder presses, chest presses, leg presses, leg extensions, leg curls, latissimus pull, chinning up, roman bench exercises, abdominal exercises, dip bar exercises, knee raisers and squatting exercises.

Although stations allowing these exercises and more are incorporated in known machines, these machines tend to be costly, space taking, and difficult to transport.

They are also large, cumbersome and complex devices and because of their size and complexity are generally used in commercial gymnasiums or health clubs and so consequently they are not suited for use in the domestic environment because of these features, unlike the present invention.

It is possible to obtain exercise devices which allow for the development and exercise of one area of the body but these devices do not constitute a full body exercise device which is the most desirable apparatus to have.

No. PCT/US81/00286 discloses a folding exercise machine which combines a number of the commonly known exercise machines such as the lat machine, the versatile bench, the leg machine and the barbell set for performing a large range of weight training exercises.

However, in order for this device to be folded and stored a number of the elements of the device must be removed from the mainframe structure. This device is designed to be sold as a complete package or for assembly by the consumer and disassembly when transportation or removal is required.

Furthermore, this device does not overcome the problem of initial weight drag due to friction and also due to the inertia of the weights, and does not provide for a variation in weight resistance throughout the exercise motion commensurate with muscle strength at a particular point in the exercise.

It is also undesirable to set up a lat machine for operation by the addition of weights on the end of a pulley for the aforesaid reasons, as this results in a linear force application against which the exerciser must work.

The present invention seeks to overcome the aforesaid problems by providing an improved combination exercise gymnasium of relatively simple construction suitable for use in the home or gymnasium which is foldable into a compact and portable unit adapted with wheels which are easily removable, and which combines the various machines suitable for exercising all zones of the body and which has improved configurational and operational geometry such that muscular improvement can be achieved in the most efficient manner as a result of correct or constant weight resistance application during particular exercises.

It is therefore an object of the invention to provide an actual free weight exercise machine to overcome the aforesaid problems associated with the simulated free weight exercise machines and exercise machines employing the pin and dead weight principle It is a further object of this invention to combine known exercise stations in one portable exercise machine configured in such a way as to employ at least one attached component machine providing a station and also acting in co-operation with and supplying resistance for another attached component machine such that the need for pulley weights is eliminated yet still allowing manifestation the free weight concept.

The invention provides an exercise machine which allows a reduction in the amount of materials used in its manufacture with a consequent financial saving and a space saving.

It is an advantage of the present invention that the problems of drag due to friction and weight inertia which are experienced in the pin weight exercise machines are overcome.

Furthermore, in some of the pin weight machines, it has been found that during exercising, the pin weights on the end of the cable can sway uncontrollably causing constant variation in the resistance weight application. The present invention seeks to eliminate this and other problems.

A further advantage of the present invention lies in the elimination of pin weight stacks which are expensive and which add to the space taken up by the presently known machines and which make portability difficult.

In its broadest form the present invention comprises:

an improved multifunction, foldable and compact exercise machine comprising:

an integral substantially upright floor supported mainframe having an overhead bar;

a bench adapted to support a body, and being pivotally attached at one end to said mainframe and having additional support means;

at least one exercise station attached to said overhead bar of said mainframe;

said exercise station or stations being interconnected with a leg machine having a weight carriage and which is pivotally connected to said mainframe;

wherein, when said station or stations are operated during an exercise, the said leg machine acts as a counterweight by virtue of the said interconnection thereby providing free weight, dragless muscle resistance for an exerciser as the station or stations moves the leg machine, thus providing proper variation of resistance to the muscle in all positions of movement, such that the weight carriage of the leg machine is subtantially vertically displaced.

Preferably, the mainframe is an elongated vertical structure having a base means, two vertical members and a horizontal member connecting the vertical members.

The bench is pivotally connected to the said vertical members and is supported underneath by a framework structure. The said pivotal connection being positioned to approximate the position of the centre of gravity of the machine—the latter being preferably located as low as possible.

Attached to the bench are two upright barbell support arms which include dip bars which are rotatably connected in gate fashion to the bench framework.

The bench comprises a split padded portion in two sections the first of which forms a seat for use in conjunction with a preacher bench the second of which forms a pivotal bench which can be adjusted into an incline, decline, supine or inversion position by means of a telescopic strut underneath the bench.

Attached to the mainframe is a pec deck and a lat machine which are both interconnected preferably via a cable running through a series of pulleys to a leg machine (previously referred to as a second machine) which is also pivotally connected to the bottom portion of the mainframe.

The leg machine is free to move in an arc with weight carriage connected thereto moving in a predominantly perpendicular sweep as the lat machine or pec deck are operated.

The machine can be folded by rotating the bench towards the mainframe after first rotating the adjustable barbell supports towards the bench. The leg machine is in the rest position before the bench is folded towards and between the vertical members of the mainframe.

The invention will now be described in detail according to the preferred but non-limiting embodiment with reference to the accompanying illustrations wherein.

Figure 1:
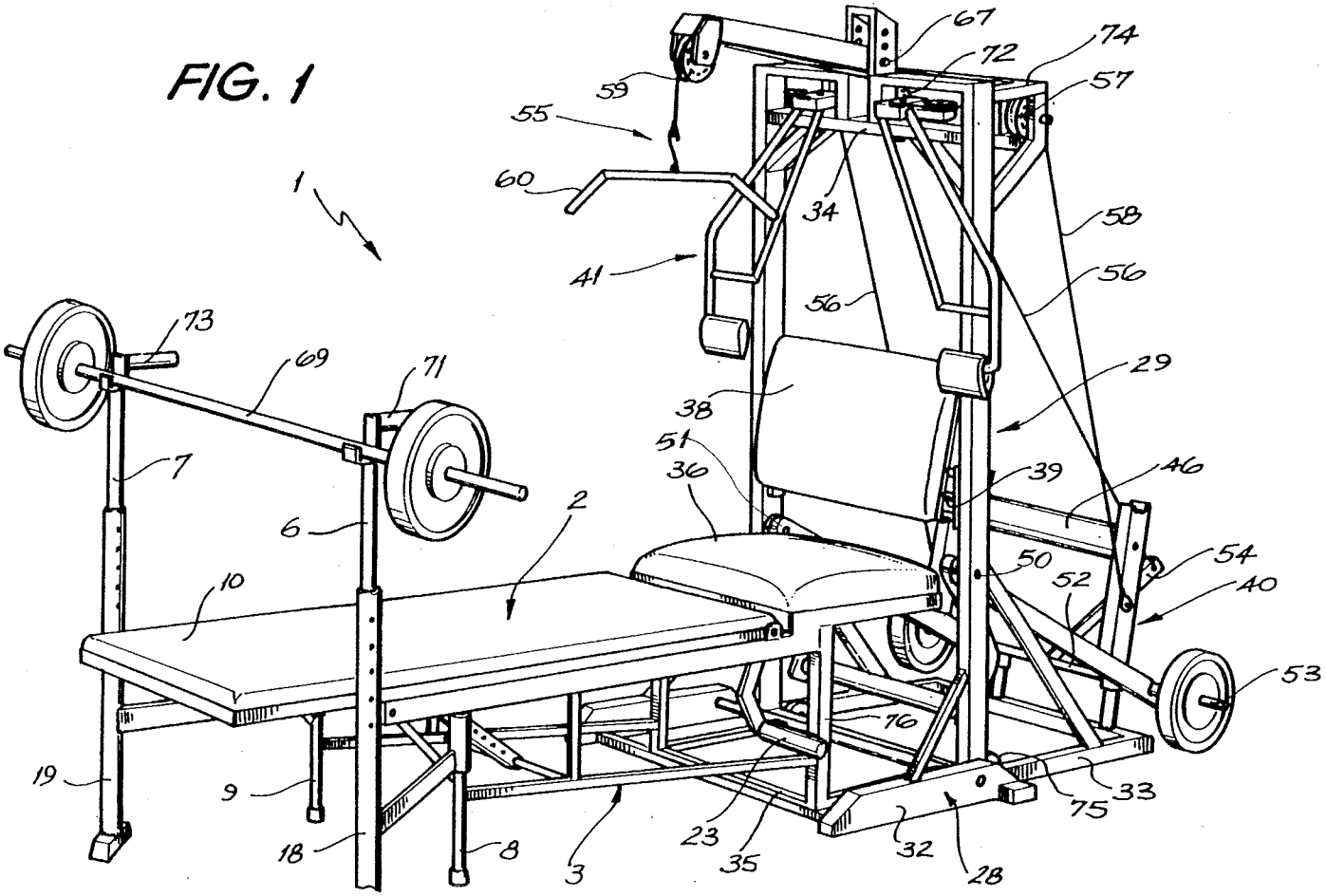
FIG. 1 shows the exercise machine in the unfolded configuration according to the preferred embodiment of the present invention.

Referring to FIG. 1 there is shown an exercise machine 1 comprised of a number of combined component machines each of which provide stations for performance of a number of different exercise functions.

A bench 2 which can be adjusted into the supine, decline and incline positions (best shown in FIGS. 2 and 3), is supported by a support truss 3 comprising top chord members 4 and bottom chord members 5.

One end of the support truss 3 is incorporated with supporting legs 8 and 9.

The bench 2 has a seat 36 pivotally connected at one end and a cushioned member 10 which is pivotally connected at each side of the member 10 and at both ends to top chord member 4.

Figure 2:
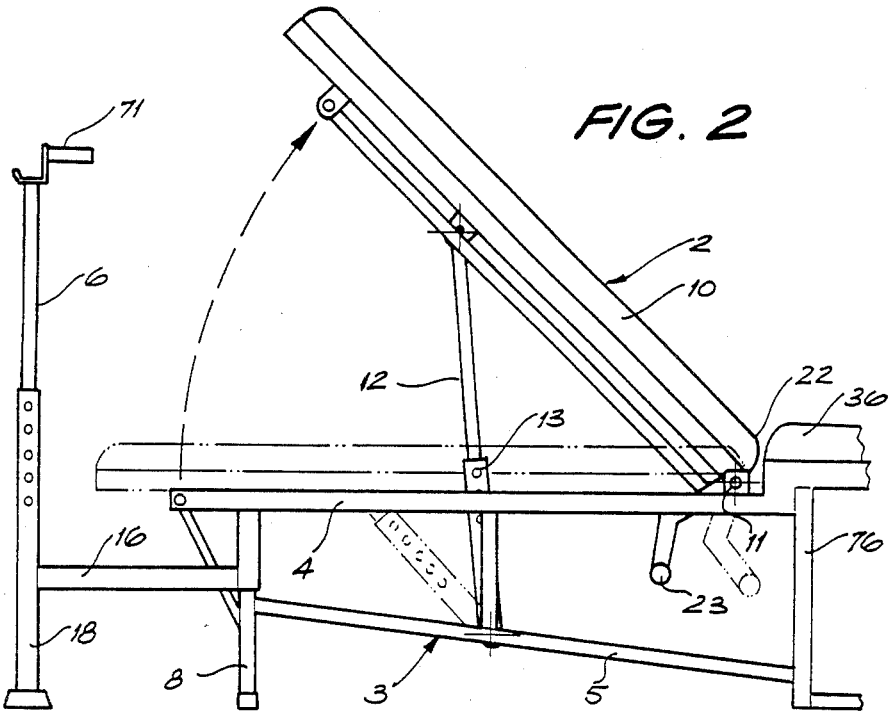
FIG. 2 shows the arc of rotation of the bench as it is rotated in the clockwise direction.

A hinge rod 11 at one end enables clockwise rotation of the cushioned member 10 as shown in FIG. 2. Attached to the underside of the cushioned member 10 is an adjustable telescopic strut 12 which is adapted with holes 13 such that a locking pin 14 can be inserted into the said holes to maintain the member 10 at the required angle of elevation.

Figure 3:
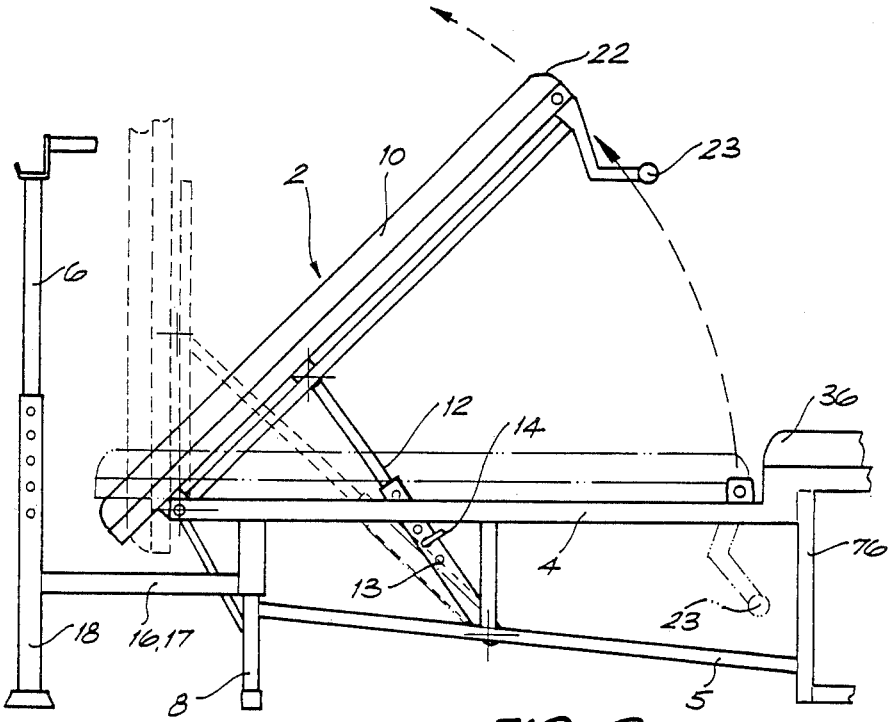
FIG. 3 shows the arc of rotation of the bench as it is rotated in the anti-clockwise direction.
Figure 4:
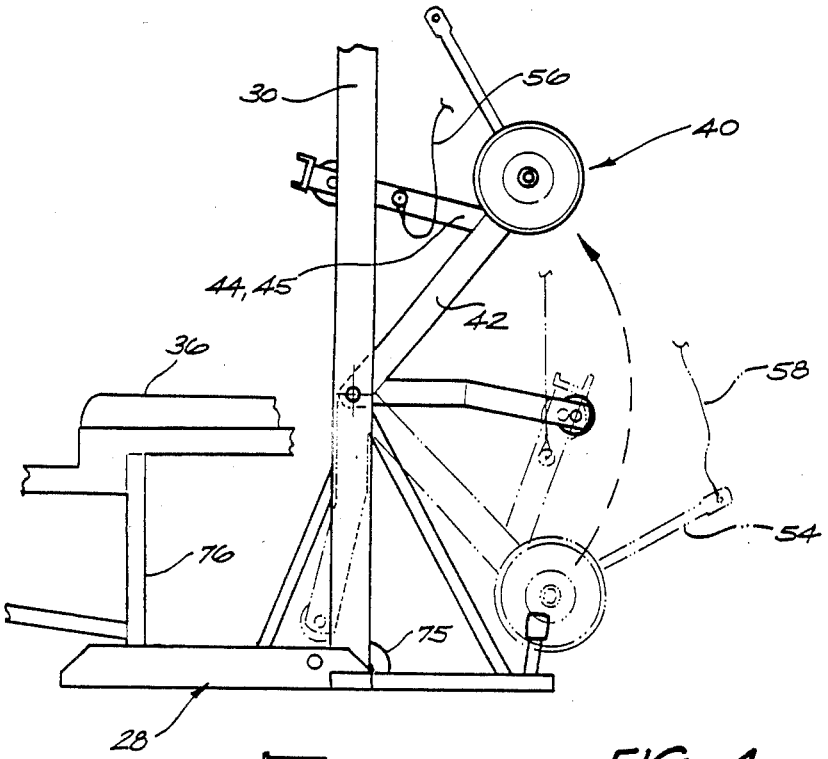
FIG. 4 shows the arc of rotation of the leg machine.
Figure 5:
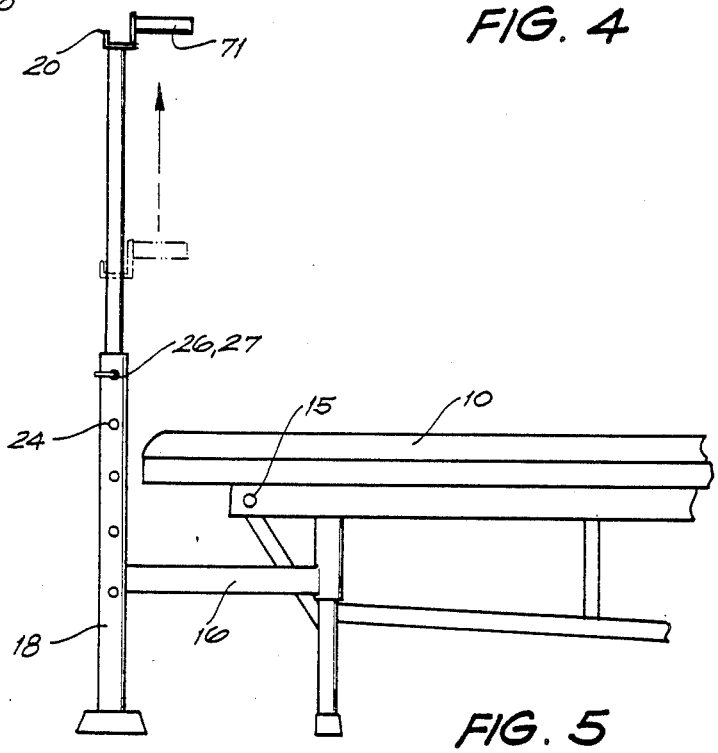
FIG. 5 shows the expanded position of the telescopic barbell support arms.

The cushioned member 10 can also be rotated in the anti-clockwise direction as shown in FIG. 3 about the pivot connection rod 15. The anti-clockwise and clockwise rotation of member 10 is also assisted by the telescopic strut 12 which expands the required distance and supports the member 10 at an angle anywhere up to and slightly in excess of 90° from the horizontal.

The seat 36 is adapted to pivot about a hinge (not shown) so that it can rotate to allow a greater degree of adjustment especially a lower adjustment of the roman bench. Also, the rotation of seat 36 avoids interference with the leg support 23.

The bench 2 allows the performance of a multiplicity of exercises such as but not limited to inversion sit ups, ordinary sit ups, bench presses or seated curls.

The set angle of the cushion member 10 can alter the degree of difficulty of the exercise depending on the requirements of the exerciser.

Also fixedly attached to the end 22 of the member 10 is a leg support means 23 last shown in FIG. 3 which enables sit ups to be performed while the feet and legs are restrained. This forces the knees to be bent during this exercise.

Preferably, pivotally attached to the supporting legs 8 and 9 at the free end of the bench 2 are interconnecting rods 16 and 17 as shown in FIG. 1 which join the legs 8 and 9 to the telescopic barbell support arms 18 and 19.

Barbell supports 18 and 19 have telescopic extendable arms 6 and 7 respectively and their height can be adjusted according to the requirements of the exerciser.

The extendable barbell support arms 6 and 7 are adapted with saddles 20 and 21 to support a barbell 69. Saddles 20 and 21 are adapted with dip bars 70 and 73 which act as handles for the exerciser whilst performing exercises. When the exercise machine is to be folded, the barbell support arms 18 and 19 can be rotated inwardly about legs 8 and 9 respectively so that they abut neatly up against the bench 2.

The barbell support arms 18 and 19 can also be rotated towards the free end of the bench such that they can be located forward of the bench support truss 3 as shown in FIG. 1. The barbell support arms 18 and 19 can also be utilised as squat racks to provide support for weights wherein squatting exercises are being performed.

The adjustability of the barbell support arms 18 and 19 allows for the dip bars to be used by all sizes of individuals regardless of shoulder width. This adjustability also allows the exercise to attack the tricep muscle from a number of different positions which is an advantage over the current state of the art static-type dip bars where the bip bar position is fixed.

Normally, the bench member 10 is located between the barbell support arms when it is in the horizontal position, however, as the bench 2 has a free end (unlike the prior art benches which usually have a leg machine attached), it can be rotated away from the barbell support arms 18 and 19 into the incline bench position, thus allowing both leg room and ease of operation when performing squatting exercises. When dip exercises are performed the same advantage is manifested.

The telescopic barbell support arms 18 and 19 are adapted with holes 24 and 25 respectively into which locking pins 26 and 27 are inserted according to the selected height.

The adjustability of the dip bars allows the exerciser to get under the barbell weight 69, which is supported by the barbell support arms 18 and 19 when squat exercises are to be performed.

As shown in FIG. 1, the bench 2 is pivotally attached to a base 28 of a mainframe 29. The mainframe 29 is comprised of two vertical support posts 30 and 31 which are fixedly attached at one end to base members 32 and 33 of base 28 respectively. At the opposite end to the base of the vertical support posts a horizontal member 34 is fixedly attached to complete the mainframe 29. Member 34 also assists in providing support for the pec deck pulleys. The top of the mainframe 29 is also adapted with a pulley frame 74 which provides a mounting means for pulleys 57.

Support legs 76 of the bench 2 are fixedly attached to an elbow 35 which is pivotally connected to the base 28 thereby effecting the pivotal connection of bench 2 to base 28 which allows the bench to be rotated upwards when folding is required.

Bench 2 also has attached to it a preacher bench seat 36 supported by cantilevered arms 37 which are cantilevered from support legs 75.

The exerciser sits on the seat 36 whilst using the preacher bench 38 for leg extension exercises or lays face down for leg curls.

Preacher bench 38 is pivotally connected to a beam 39 which is detachably and pivotally connected to the mainframe vertical support posts 30 and 31.

Beam 39 preferably is pivotally attached to both of the support posts at both ends and detachably attached to both of the support posts 30 and 31 in the form of a gate.

This enables the beam 39 with the preacher bench attached to be rotated to either side and away from the bench 2 so that access can be easily gained to the area between posts 30 and 31 for performing certain exercises—in particular leg exercises.

The preacher bench 38 is pivotally connected to the beam 39 such that it can be positioned either facing in the direction of the bench or away from the bench according to the particular exercise to be performed.

For instance, the bench 38 serves as a back rest when performing exercises on the pec deck 41. Alternatively the bench 38 can be used as a preacher bench for performing bicep exercises.

Also attached to the mainframe 29 is a leg machine 40, and a pec deck 41 and an adjustable lat machine 55.

The leg machine 40 is pivotally connected to vertical posts 30 and 31 at pivot points 50 and 51 respectively and comprises main arms 42 and 43 to which are fixedly attached oblique arms 44 and 45 respectively which are interconnected by connecting rod 46. Connecting rod 46 is adapted with pads for comfort as the exercisers legs activate the leg machine by engaging with this rod depending upon the particular leg exercise being performed.

As shown in FIG. 1 the main arms 42 and 43 are interconnected at the end opposite to the pivot end by means of connecting rod 52. The rod 52 has telescopic cantilevered portions 53 which extend beyond the main arms 42 and 43. The telescopic cantilevered portions are are intended for supporting barbell weights of varying sizes.

The leg machine 40 also has a strut member 54 which fits inside an orifice allowing adjustment of the position of the leg machine along the length of the strut.

The strut also sits on the base of the machine 28 and provides support for the leg machine in the selected position.

This variable positioning of the leg machine along the strut is particularly advantageous when use is made of the leg machine for calf exercises. The position of the leg machine determined by the position on the strut is largely determined by the physical size of the exerciser using the machine.

Figure 6:
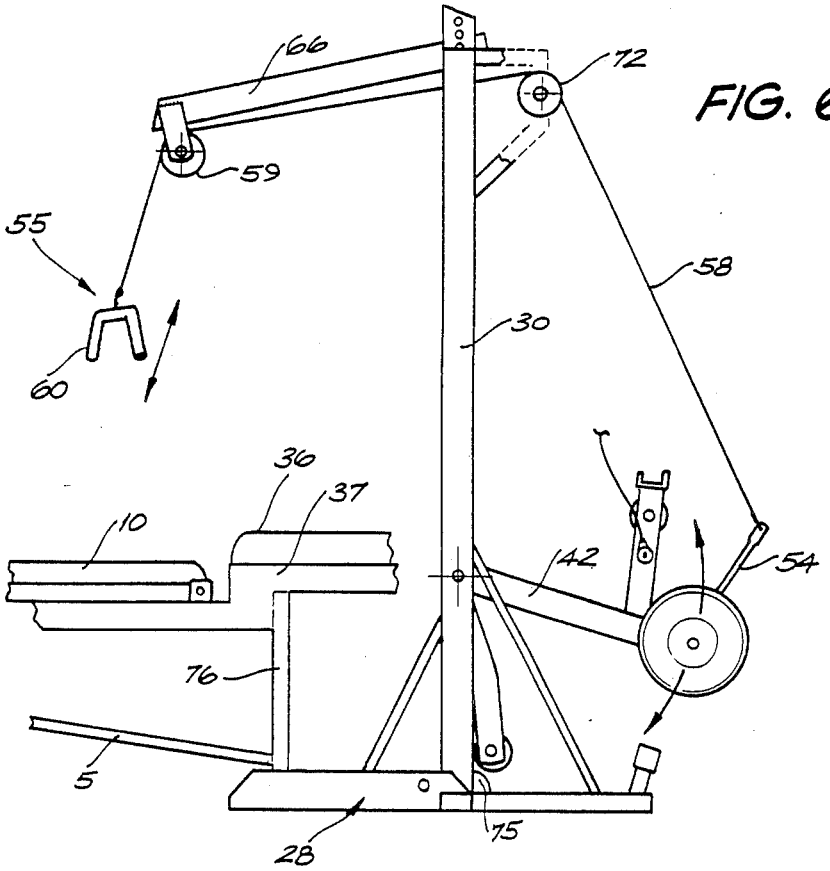
FIG. 6 shows the leg machine which provides the resistance weight acting in co-operation with the lat machine.
Figure 8:
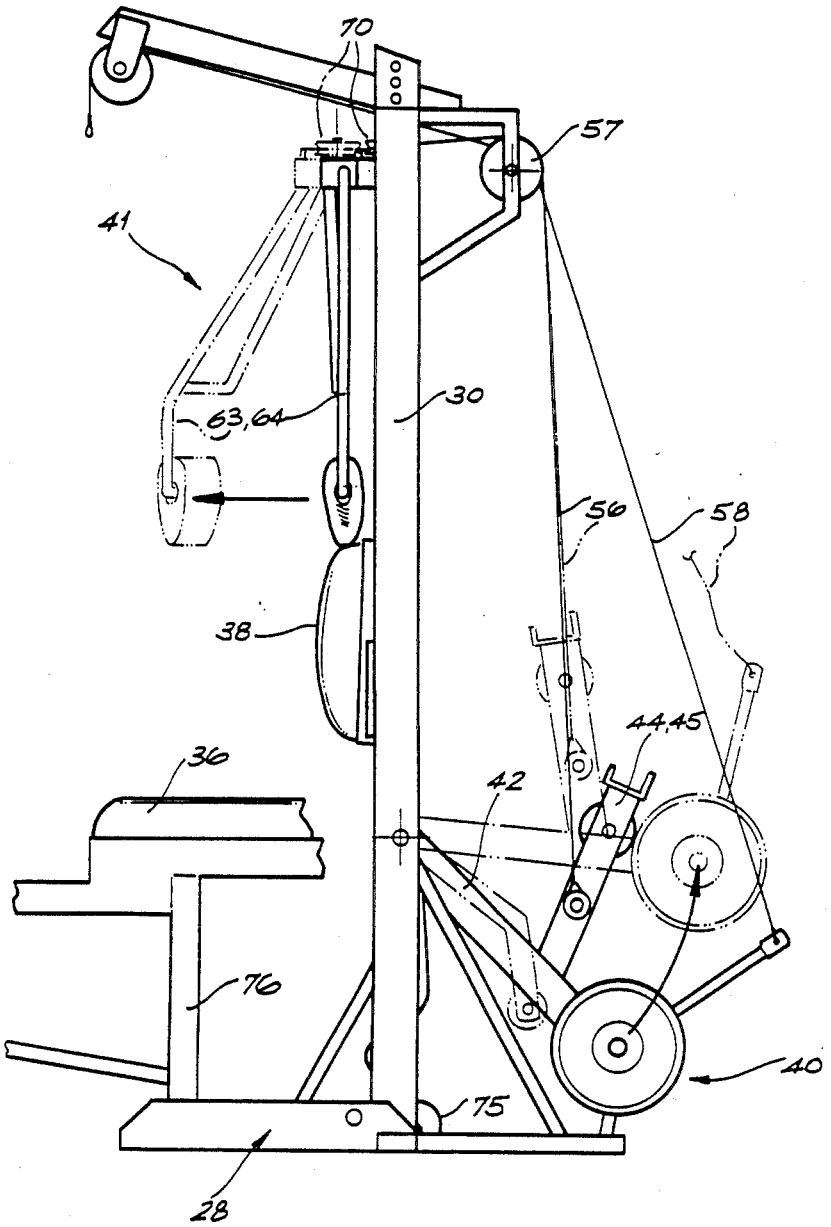
FIG. 8 shows the pec deck as connected to the leg machine wherein the leg machine is acting as the resistance weight.

An important feature of this invention is that the leg machine 40 as shown in FIG. 8 provides the counter weight for the pec deck 41 by an interconnection provided by cables 56 which passes through a pulley arrangement 57. The leg machine also provides counterweight for the lat machine by connection with cable 58 and a pulley arrangement which has a front pulley 59 and a rear pulley 72. This is best shown in FIG. 6. The traditional position of the leg machine has been moved from the end of the bench and relocated at the opposite mainframe end of the bench so that it can be used in conjunction with the Pec Dec and the Lat Machines. This has the advantage of clearing the area between the barbell support arms 18 and 19.

The use of the leg machine as a counter weight eliminates the need for pin weights which are commonly used in the prior art exercise machines.

In using the leg machine as so described in conjunction with the other machine components, drag previously experienced using the pin weights is eliminated.

In pin weight machines the weight stacks slide on guide rails. Even when roller mechanisms are added to the weight carriage drag is still experienced. In the present invention no drag is experienced as the resistance weight that being the leg machine—swings in its predominantly perpendicular arc. A predominantly perpendicular movement of the weight eliminates drag, whilst supplying resistance. The resistance weight of the leg machine 40 can be varied by placing weights on cantilevered portions 53.

The particular geometry of the arc defined by the leg machine, when in use with the lat machine, creates an even resistance for the exerciser due to a predominantly perpendicular sweep of movement of the leg machine weight carriage regardless of the point of attachment of the cable 58 which joins the lat machine to the leg machine. The cable attachment point on the leg machine is at optimum position when connected as shown in FIG. 6.

FIG. 6 shows the manner in which the lat machine is connected to the leg machine according to one embodiment. The cable 58 is shown connected to the strut 54.

In use, the exerciser grasps handle 60 and pulls it in a substantially downward direction. This tension cable 58 and eventually exerts a pulling load on the leg machine 40. The leg machine then pivots about the pivot points 50 and 51 and defines an arc which is substantially perpendicular.

It has been found in practice that there is an optimum cable attachment point for both lat machine and for the pec deck on the leg machine to obtain the maximum mechanical advantage.

Ideally, the cable attachment points for the lat machine are placed on positions to achieve the most advantageous arc of movement relative to the rear circumferential edge of the rear pulley 72.

The optimum position for the cable 58 to be attached has been found to be located on the support strut 54 as shown in FIG. 6.

The aim of obtaining the optimum cable connection positions is to allow the cable attachment positions to move in the most complimentary arc in relation to the Pec Deck and Lat Machine rear pulleys 57 and 72 respectively.

Therefore, a straight line drawn through the leg machine fulcrum point and bisecting the midpoint of the arcs created by the cable attachment points for the Pec Deck and Lat Machines in their prescribed movements will be at right angles to a straight line drawn from the bisection point of arcs created by cable attach point to the outer rear circumferential working edge of the rearward Pec Deck and Lat Machine pulleys.

The Lat Machine is able to be adjusted by means of a pivoting pulley arm 66, by removing a locking pin 67 and raising or lowering the lat machine front pulley 59. The adjustable Lat Machine front pulley arm 66 is locked into position by means of standard type selection holes utilizing a locking pin that secures the Lat Machine front pulley 59 at the desired height.

Because of the adjustable height of the Lat machine pulley, it is possible to select an appropriate resistance curve for tricep exercises, for instance, the exerciser can select either a constant resistance or a resistance which is first easy then gets harder or a resistance which is first hard then becomes easier.

As with the lat machine, the pec deck 41 also utilizes the leg machine 40 as the resistance weight. The pec deck 41 is connected to the top of the mainframe 29 of the exercise machine.

Figure 7:
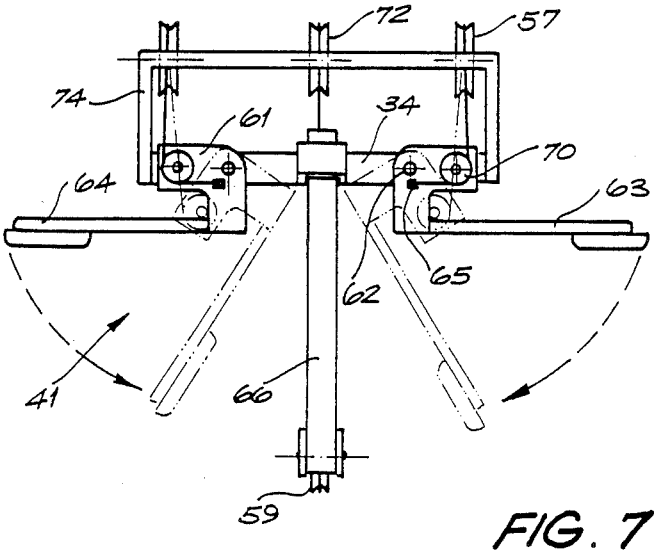
FIG. 7 shows from a top view of the exercise machine the operational line defined by the pec deck when in use in conjunction with the leg machine.

FIG. 7 shows the operational arc of movement of the pec deck from a top view.

This FIGURE also shows the relation between the lat machine rear pulley 72 and the pec deck pulleys 57 according to a preferred embodiment. FIG. 8 shows the arc of displacement of the leg machine when connected to the pec deck.

Showing the cables 56 as they attach to the leg machine arms 44 and 45.

The same geometry which the lat machine utilises applies to the leg machine when it is connected to the pec deck to act as the counterweight.

As shown in FIG. 7 the pec deck is pivotally connected to struts on the chord member 34 of the mainframe 29 by means of an elbow 61. The connection can also be assisted by partial pulleys 70. The cables 56 are attached to the partial pulleys 70 which are adapted to pivot about points 62. When the arms 63 and 64 of the pec deck 41, are rotated towards each other by the exerciser the cables 56 which are fixedly attached at points 65 on the partial pulleys 70 are tensioned such that a lifting load is placed on the leg machine 40.

An identical fixing arrangement for the cables 56 is adapted to both arms of the pec deck.

It has not been previously known for an exercise machine which can be compactly folded into one unit and which utilises its own component machines to assist in the effective operation of other component machines and to provide as many exercise functions without adjustment to the machine as this machine does.

The multiplicity of exercise functions is of utmost importance when an exerciser is performing multiple exercise routines commonly known as supersets.

Scientifically planned exercise groupings enable an exerciser to obtain otpimum benefit from 'working out' on an exercise machine provided each of the workstations required are easily accessable. The present invention is of particular advantage in this respect where a series of different exercises must be performed in rapid succession. The machine does not have to be changed or 'set up' for successive exercises.

For instance, a superset comprising bench press exercises and pec deck machine exercises can be performed in succession without having to adjust the machine. Commonly in gymnasiums it is necessary to wait while exercise machines are adapted for a particular exercise in a sequence or even worse, a person may have to change machines and wait for another exerciser to finish.

The present invention eliminates these problems by providing numerous work stations already set up on the one machine. Among the workstations are;

the adjustable bench which can be angled in the supine, decline or incline positions, (generally used for exercising muscles in the pectoral region of the body);

the adjustable roman bench which is used for sit ups and inversions to exercise the abdominal muscles and relieve compression of spinal vertebra;

the squat racks for squat exercises and the dip bars for tricep press exercises;

the preacher bench for performing preacher bench curls (this also serves as a back rest for the pec deck as well as locking the bench into position when not in use;

the pec deck machine for shoulder and upper back exercises; and the lat machine for exercising triceps and for performing lat machine pull downs; and a seated calf machine for performing calf exercises.

A further feature of this invention is its foldability.

There have been exercise machines in the past which have been adapted for folding, however, it has not been known for an exercise machine to have as many stations as the present machine and yet be able to be folded into a compact upright unit.

Figure 9:
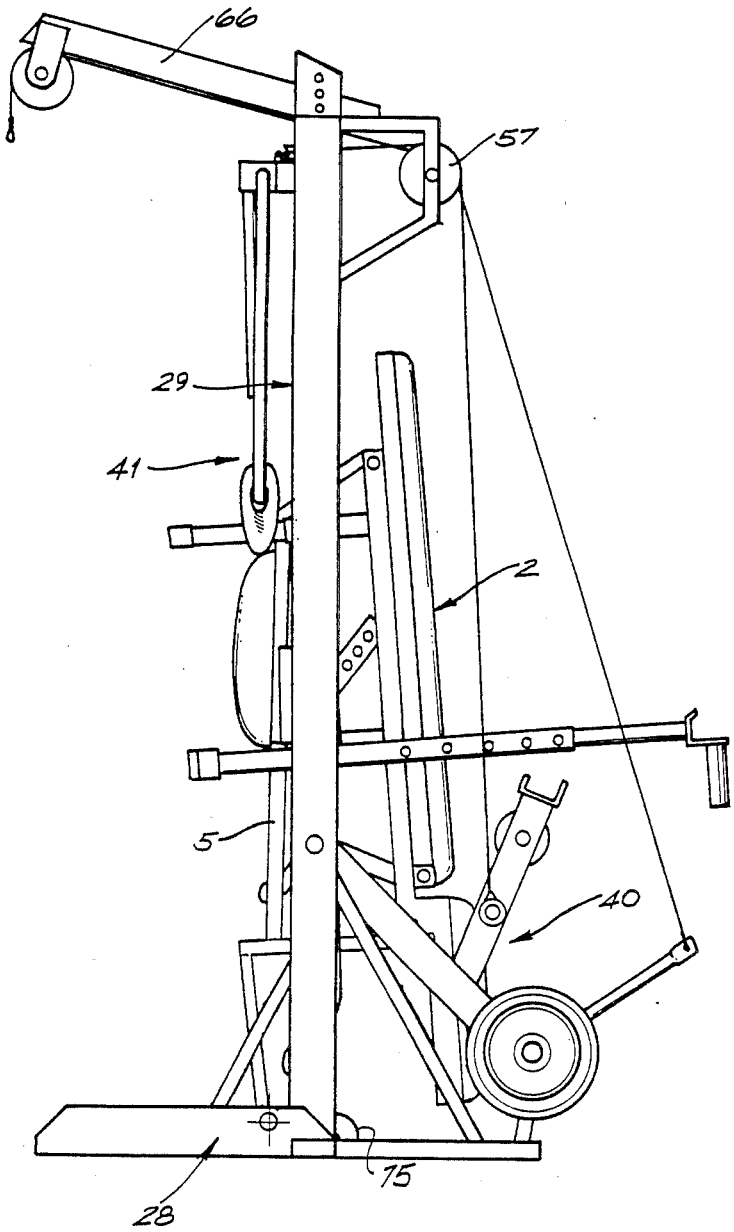
FIG. 9 shows the exercise machine in the folded configuration for storage and transportation.

The unit is so compact when folded that the whole machine only takes up the floor space taken by the base 28 of the mainframe:

FIG. 9 shows the exercise machine in the folded configuration.

To fold the machine, the barbell support arms 18 and 19 are rotated towards the bench 2. The bench cushion 10 is rotated to the horizontal position. Next, the complete bench 2 is rotated upwards towards the mainframe 29 so that it fits between the vertical support posts 30 and 31 of the mainframe and beneath the pulley arrangement. The leg machine 40 is allowed to rotate as far as possible downwards such that it locates within the space defined by the base 28. The Lat Machine handle 60 and the cables 56 and 58 can be detached if required.

When folded, the exercise machine can be moved on wheels 75 which are attached to mainframe base 28.

It will be recognised by persons skilled in the art that numerous variations and modifications can be made to the present invention as hereinbefore described without departing from the overall spirit and scope of the invention.

I claim:

1. An improved multifunction, foldable and compact exercise machine comprising:

an integral substantially upright floor supported mainframe having at least an overhead member;

a bench adapted to support a body, and being pivotally attached at one end to said mainframe and having additional support means;

at least one exercise station attached to said overhead member of said mainframe;

said exercise station or stations being interconnected with a leg machine having a weight carriage and which is pivotally connected to said mainframe;

wherein, when said station or stations are operated during an exercise, the said leg machine acts as a counterweight by virtue of the said interconnection thereby providing free weight, dragless muscle resistance for an exerciser as the station or stations moves the leg machine, thus providing proper variation of resistance to the muscle in all positions of movement, such that the weight carriage of the leg machine is substantially vertically displaced;

said mainframe comprises at least two upright vertical members interconnected by said overhead member which is substantially horizontal; said mainframe being supported by a base means connected to said vertical members;

said bench is elongated and is disposed between and connected at one end to said upright vertical members;

said additional bench support means is comprised of a framework structure having at least one ground engaging leg at the unpivoted end of the bench;

said mainframe has pivotally attached to it at least two substantially upright and height and width adjustable barbell weight support posts;

said barbell weight support posts are adapted with a cradle to support a barbell;

said bench comprises two seat portions mounted on the framework, the first of said portions being pivotally connected at the end of the bench connected to the mainframe, the second of said portions being an adjustable incline portion pivotally connected to the said framework structure and supported by means of a telescopic strut connecting said incline portion to said framework;

said telescopic strut is adjustable by means of a detachable pin aligning in holes in the members of the telescopic strut;

said mainframe has attached to it at least one exercise station above the said bench;

said exercise station or stations are attached to the upper portion of the said mainframe;

said exercise station is a preacher bench or lat machine or a pec deck; and said preacher bench is pivotally connected to the vertical upright members and rotatably connected to a horizontal member spanning between the said vertical members.

2. An exercise machine according to claim 1, wherein said interconnection comprises a pulley arrangement.

3. An exercise machine according to claim 2, wherein the said pulley arrangement comprises an arm, disposed transversely to the overhead member and having wheels at either end.

4. An exercise machine according to claim 3, wherein the arm can be adjusted vertically.

5. An exercise machine according to claim 4, wherein the arm is adjustable by means of a locking pin which aligns with holes in the transverse member and in an anchor plate adjacent thereto.

6. An exercise machine according to claim 5, wherein pulley wheels are disposed rearward and forward on the overhead member and also mounted in a frame connected to the vertical upright members.

7. An exercise machine according to claim 1, wherein the said overhead member has additional pulley assemblies located at or near either end of said overhead member, each of said pulley assemblies being pivotally mounted and connected to said pec deck so as to move in conjunction with said pec deck thereby causing movement in said leg machine.

8. An exercise machine according to claim 7, wherein the pulley assemblies and the leg machine are interconnected by means of a cable which runs from the leg machine and terminates at an anchorage on each said pulley assemblies.

9. An exercise machine according to claim 8, wherein the preacher bench is pivotally connected to the vertical upright members and rotatably connected to a horizontal member spanning between the said vertical members.

10. An exercise machine according to claim 1, wherein said leg machine is pivotally attached to the lower half of the vertical members of the mainframe.

11. An improved multifunction, foldable and compact exercise machine comprising:

an integral substantially upright floor supported mainframe having at least an overhead member;

a bench adapted to support a body, and being pivotally attached at one end to said mainframe and having additional support means;

at least one exercise station attached to said overhead member of said mainframe;

said exercise station or stations being interconnected with a leg machine having a weight carriage and which is pivotally connected to said mainframe;

wherein, when said station or stations are operated during an exercise, the said leg machine acts as a counterweight by virtue of the said interconnection thereby providing free weight, dragless muscle resistance for an exerciser as the station or stations moves the leg machine, thus providing proper variation of resistance to the muscle in all positions of movement, such that the weight carriage of the leg machine is substantially vertically displaced;

said mainframe comprises at least two upright vertical members interconnected by said overhead member which is substantially horizontal; said mainframe being supported by a base means connected to said vertical members; and said interconnection comprises a pulley arrangement.

12. An exercise machine according to claim 11, wherein the said overhead member has additional pulley assemblies located at or near either end of said overhead member, each of said pulley assemblies being pivotally mounted and connected to said pec deck so as to move in conjunction with said pec deck thereby causing movement in said leg machine.

13. An exercise machine according to claim 12, wherein the pulley assemblies and the leg machine are interconnected by means of a cable which runs from the leg machine and terminates at an anchorage on each said pulley assemblies.

14. An exercise machine according to claim 13, wherein the preacher bench is pivotally connected to the vertical upright members and rotatably connected to a horizontal member spanning between the said vertical members.

15. An exercise machine according to claim 11 wherein the said bench is elongated and is disposed between and connected at one end to said upright vertical members.

16. An exercise machine according to claim 15 wherein the said additional bench support means is comprised of a framework structure having at least one ground engaging leg at the unpivoted end of the bench.

17. An exercise machine according to claim 16 wherein the said mainframe means has pivotally attached to it at least two substantially upright and height and width adjustable barbell weight support posts.

18. An exercise machine according to claim 17 wherein the said barbell weight support posts are adapted with a cradle to support a barbell.

19. An exercise machine according to claim 18 wherein said bench comprises two seat portions mounted on the framework, the first of said portions being pivotally connected at the end of the bench connected to the mainframe, the second of said portions being an adjustable incline portion pivotally connected to the said framework structure and supported by means of a telescopic strut connecting said incline portion to said framework.

20. An exercise machine according to claim 19 wherein the said telescopic strut is adjustable by means of a detachable pin aligning in holes in the members of the telescopic strut.

21. An exercise machine according to claim 26 wherein the said mainframe has attached to it at least one exercise station above the said bench.

22. An exercise machine according to claim 21 wherein the exercise station is attached to the substantially horizontal overhead bar of the mainframe.

23. An exercise machine according to claim 21 wherein the said exercise station or stations are attached to the upper portion of the said mainframe.

24. An exercise machine according to claim 23 wherein there are three exercise stations being a preacher bench, a lat machine and a pec deck.

25. An exercise machine according to claim 23 wherein the exercise station is a preacher bench or lat machine or a pec deck.

26. An exercise machine according to claim 25 wherein the preacher bench is pivotally connected to the vertical upright members and rotatably connected to a horizontal member spanning between the said vertical members.

27. An exercise machine according to claim 11 wherein the said leg machine is pivotally attached to the lower half of the vertical members of the mainframe.

28. An exercise machine according to claim 11 wherein the said pulley arrangement comprises an arm, disposed transversely to the overhead member and having wheels at either end.

29. An exercise machine according to claim 28 wherein the arm can be adjusted vertically.

30. An exercise machine according to claim 29 wherein the arm is adjustable by means of a locking pin which aligns with holes in the transverse bar and in an anchor plate adjacent thereto.

31. An exercise machine according to claim 30 wherein pulley wheels are disposed rearward and forward on the overhead member and also mounted in a frame connected to the vertical upright members.

32. An improved multifunction, foldable and compact exercise machine comprising:

an integral substantially upright floor supported mainframe having at least an overhead member;

a bench adapted to support a body, and being pivotally attached at one end to said mainframe and having additional support means;

at least one exercise station attached to said overhead member of said mainframe;

said exercise station or stations being interconnected via said overhead member and force direction changing pulley means with a leg exercising machine having a weight carriage means and which is pivotally connected to said mainframe;

wherein, when said station or stations are operated during an exercise, the said leg exercising machine acts as a counterweight for said at least one exercise station by virtue of the said interconnection thereby providing free weight, dragless muscle resistance for an exerciser as the station or stations moves the leg exercising machine, thus providing proper variation of resistance to the muscle in all positions of movement, such that the weight carriage of the leg exercising machine is substantially vertically displaced.

33. An exercise machine according to claim 32, wherein the said mainframe comprises at least two upright vertical members interconnected by said overhead member which is substantially horizontal; said mainframe being supported by a base means connected to said vertical members, said interconnection passing from said leg exercising machine via support means on said overhead member to said exercise station or stations.

34. An improved exercise machine as in claim 32, wherein said interconnection includes cable means operatively associated with cable means and said pulley means, and said cable means being connected to said exercise station, trained over said pulley means and connected to said leg exercise means.

35. An improved exercise machine as in claim 32, wherein said leg exercise machine includes weight carriage means having arm-like means pivotally connected adjacent one end to said mainframe and having weight means at the other end thereof and means associated with said arm for interconnection with said cable means.

36. An improved exercise machine as in claim 34, wherein said leg exercise machine includes a plurality of positions on said arm for interconnection to said cable means so as to control the force required at the exercise station to raise the weights at the leg station.

37. An improved exercise machine as in claim 32, wherein there are provided a plurality of exercise stations, each of which is constructed for interconnection with said leg machine.

38. An improved exercise machine as in claim 32, wherein said bench means is pivotally attached to said mainframe on one side of said mainframe, said exercise station is on the bench side of the overhead member and said leg exercise machine is on the side of the mainframe and overhead head member opposite from the bench and exercise station.

* * * * *